US006364985B2

(12) United States Patent
Sogabe et al.

(10) Patent No.: US 6,364,985 B2
(45) Date of Patent: Apr. 2, 2002

(54) THERMAL TRANSFER RECORDING MEDIUM

(75) Inventors: Jun Sogabe; Tetsuo Hoshino, both of Osaka (JP)

(73) Assignee: Fujicopian Co., Ltd., Osaka-fu (JP)

( * ) Notice: Subject to any disclaimer, the term of this patent is extended or adjusted under 35 U.S.C. 154(b) by 0 days.

(21) Appl. No.: 09/863,142

(22) Filed: May 22, 2001

Related U.S. Application Data

(62) Division of application No. 09/234,202, filed on Jan. 20, 1999, now abandoned.

(30) Foreign Application Priority Data

Jan. 20, 1999 (JP) ..... 10-011216

(51) Int. Cl.[7] ..... B41M 5/34
(52) U.S. Cl. ..... 156/235; 428/195; 428/488.4
(58) Field of Search ..... 156/235; 428/195, 428/484, 488.1, 488.4, 913, 914

(56) References Cited

U.S. PATENT DOCUMENTS 5,053,267 A 10/1991 Ide ..... 428/195

FOREIGN PATENT DOCUMENTS

| | | |
|---|---|---|
| EP | 0 510 661 A1 | 10/1992 |
| EP | 0 698 504 A1 | 2/1996 |
| JP | 10329435 | 12/1998 |

*Primary Examiner*—Bruce H. Hess
(74) *Attorney, Agent, or Firm*—Fish & Neave

(57) ABSTRACT

A thermal transfer recording medium for forming a color image by superimposingly transferring plural different color inks, comprising a foundation and a first and second color ink layer provided on the foundation, and a first and second release layer comprising a wax interposed between the foundation and the respective color ink layers, wherein the heat of fusion C1 of the release layer for a first color and the heat of fusion C2 of the release layer for a second color satisfy the relationship represented by formula (I):

$$C1<C2 \quad \text{(I)}.$$

6 Claims, 1 Drawing Sheet

THERMAL TRANSFER RECORDING MEDIUM

This application is a division of U.S. application Ser. No. 09/234,202, filed Jan. 20, 1999 now abandoned.

BACKGROUND OF THE INVENTION

The present invention relates to a thermal transfer recording medium for use in thermal transfer recording devices such as thermal printers and facsimile terminal equipment. More particularly, the present invention relates to a thermal transfer recording medium for use in formation of a multi-color or full-color image by superimposing-transfer of plural different color inks.

Hitherto there has been performed the formation of a multi-color or full-color image involving a region developing a color by virtue of subtractive color mixture wherein plural different color inks are superimposingly transferred one on another on a receptor by means of a thermal transfer printer or the like. As the thermal transfer recording medium for such a method there has been widely used one having the structure wherein a release layer comprising a wax as a main ingredient is interposed between a foundation and a color ink layer to improve the transferability.

When plural different color inks are superimposingly transferred to form a multi-color or full-color image on a receptor by use of the above-mentioned thermal transfer recording medium, the release layer comprising a wax as a main ingredient would exist on the top of first color ink dots formed on the receptor, causing the problem wherein second color ink dots are not satisfactorily superimposed onto the first color ink dots due to the presence of the release layer on the first color ink dots.

In view of the aforesaid problem of the prior art, it is an object of the present invention to provide a novel technique wherein, in forming a color image by use of a thermal transfer recording medium having the structure wherein a release layer comprising a wax as a main ingredient is interposed between a foundation and a color ink layer, second color ink dots can be satisfactorily transferred onto first color ink dots.

This and other objects of the present invention will become apparent from the description hereinafter.

SUMMARY OF THE INVENTION

The present invention provides a thermal transfer recording medium for forming a color image by superimposingly transferring plural different color inks, comprising a foundation and a first and second color ink layer provided on the foundation, and a first and second release layer comprising a wax interposed between the foundation and the respective color ink layers, wherein the heat of fusion C1 of the release layer for a first color and the heat of fusion C2 of the release layer for a second color satisfy the relationship represented by formula (I):

$$C1<C2 \quad \text{(I)}.$$

According to an embodiment of the present invention, the heat of fusion C1 of the release layer for a first color preferably satisfies the relationship represented by formula (II):

$$160\ mJ/mg \geqq C1 \quad \text{(II)}.$$

According to another embodiment of the present invention, the heat of fusion C1 of the release layer for a first color and the heat of fusion C2 of the release layer for a second color preferably satisfy the relationship represented by formula (III):

$$30\ mJ/mg \leqq C2-C1 \quad \text{(III)}.$$

According to a further embodiment of the present invention, plural different color ink layers are disposed in a side-by-side relation on single foundation with respective release layers intervening therebetween.

According to still further embodiment of the present invention, plural different color ink layers are disposed on separate foundations with respective release layers intervening therebetween.

DETAILED DESCRIPTION

Figure 1:
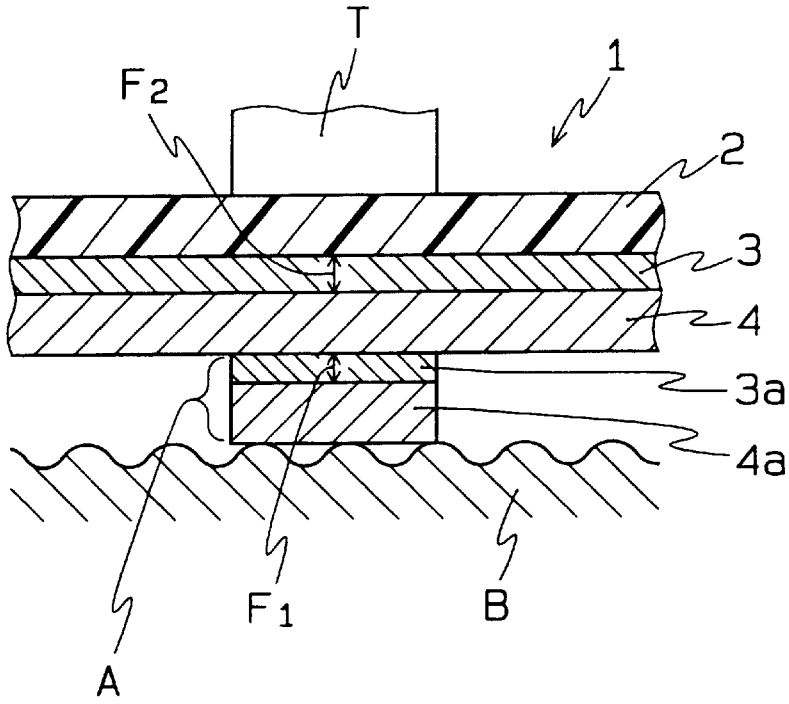
FIG. 1 is a schematic sectional view showing a situation where a color image is formed by superimposing-transfer using an example of the thermal transfer recording medium of the present invention on a thermal transfer printer.

The terms "first color" and "second color" used in the present invention are defined as follows: When two different color inks are superimposingly transferred one on the other, the one color which is transferred previous to the other color is referred to as "first color", and the other color which is transferred on the first color is referred to as "second color". For example, in the case of superimposingly transferring three different color inks of yellow (hereinafter referred to as "Y" in some cases), magenta (hereinafter referred to as "M" in some cases) and cyan (hereinafter referred to as "C" in some cases) in the order of Y, M and C, Y is a first color and M is a second color when the transfer of Y and M is focused on, and M is a first color and C is a second color when the transfer of M and C is focused on.

The definition of the terms "release layer for a first color" or "first release layer" or "first release layer" and "release layer for a second color" or "second release layer" is as follows: The release layer which is interposed between a foundation and a color ink layer giving a first color is referred to as "release layer for a first color" or "first release layer". The release layer which is interposed between a foundation and a color ink layer giving a second color is referred to as "release layer for a second color" or "second release layer".

The thermal transfer recording medium of the present invention has the structure wherein a release layer comprising a wax as a main ingredient is interposed between a foundation and a color ink layer. The thermal transfer recording medium of the present invention includes the following two embodiments: One embodiment wherein plural different color ink layers are disposed in a side-by-side relation on single foundation with respective release layers intervening therebetween; and another embodiment wherein plural different color ink layers are disposed on separate foundations with respective release layers intervening therebetween.

The thermal transfer recording medium of the present invention is characterized in that the heat of fusion C1 of the release layer for a first color and the heat of fusion C2 of the release layer for a second color satisfy the relationship represented by formula (I):

$$C1<C2 \quad \text{(I)}.$$

preferably the relationship represented by formula (III):

$$30\ mJ/mg \leqq C2-C1 \quad \text{(III)}.$$

The heat of fusion C1 of the release layer for the first color preferably satisfies the relationship represented by formula (II):

$$160\ mJ/mg \geqq C1 \quad \text{(II)}.$$

By virtue of the feature that the heat of fusion C1 of the release layer for a first color and the heat of fusion C2 of the release layer for a second color satisfy the relationship represented by formula (I), preferably the relationship represented by formula (II) and/or the relationship represented by formula (III), a desired effect that second color ink dots can be satisfactorily transferred onto first color ink dots can be exhibited.

The reason why the above-mentioned effect is exhibited will be explained by referring to the drawing.

FIG. 1 is a schematic sectional view showing the situation where a color image is formed by superimposing-transfer using the thermal transfer recording medium of the present invention on a thermal transfer printer.

In FIG. 1, reference numeral 1 denotes a thermal transfer recording medium having the structure wherein a color ink layer 4 is provided on a foundation 2 with a release layer 3 intervening between the foundation 2 and the color ink layer 4. The recording medium 1 shown in FIG. 1 is adapted for a second color. An ink image for a first color has been formed on a receptor (paper sheet) B by using a recording medium for the first color (in FIG. 1, only one ink dot A is illustrated for simplification of explanation). The ink dot A is composed of a color ink layer 4*a* fixed to the receptor B and a release layer 3*a* disposed on the color ink layer 4*a*.

The recording medium 1 for the second color is superposed on the receptor B having the ink dot A thereon. The combined recording medium 1/receptor B is heated from the foundation 2 side with a thermal head (in FIG. 1, only one heating element T is illustrated).

The heat of fusion C1 of the release layer 3*a* for the first color is smaller than the heat of fusion C2 of the release layer 3 for the second color. Accordingly, after the combined recording medium 1/receptor B is heated with the heating element T so that the release layer 3 and the release layer 3*a* are melted, the release layer 3*a* of the ink dot A for the first color is cooled faster than the release layer 3 for the second color. Thus, when the recording medium 1 for the second color is peeled off from the receptor B, the cohesive force F2 of the release layer 3 is smaller than the cohesive force F1 of the release layer 3*a* and, hence, the color ink layer 4 is peeled off on the release layer 3 side, so that an almost perfect ink dot for the second color is transferred onto the ink dot A for the first color. That is, the size of the ink dot for the second color is almost the same as the size of the ink dot A for the first color. Such a performance is more favorably exhibited when the heat of fusion C1 of the release layer for the first color and the heat of fusion C2 of the release layer for the second color satisfy the relationship represented by formula (III).

Thus, according to the present invention, ink dots for the second color are favorably superimposingly transferred onto the ink dots in a predetermined region of a first color image, resulting in a desired subtractive color mixture to give a multi-color or full-color image with good color reproducibility.

If C1≧C2, the ink dots for the second color are not satisfactorily transferred onto the ink dots for the first color, resulting in poor color reproducibility. If C1 is larger than 160 mJ/mg, the release layer for the first color tends to be hardly solidified by the time when the recording medium for the second color is peeled off from the receptor after having been heated, under such a printing condition that the printing speed is about 100 cps(characters/second) which is a usual printing speed at the present time, and, hence, the aforesaid performance is not favorably exhibited. Because of this, C1 is preferably not larger than 160 mJ/mg.

With respect to other constituents of the thermal transfer recording medium of the present invention, conventional ones can be adopted without any particular limitation so long as the heat of fusion of the respective release layers satisfies the aforesaid condition.

As the color ink layer there are usually used yellow, magenta and cyan ones. A black ink layer is optionally used. Usually, however, the black ink layer is not superimposed on other color ink layers. In that case, the release layer corresponding to the back ink layer does not need to satisfy the aforesaid condition.

These yellow, magenta and cyan ink layers and optionally a black ink layer may be disposed either on separate foundations or on single foundation.

According to an example of the thermal transfer recording medium wherein the respective color ink layers are disposed on single foundation, a yellow ink layer, a magenta ink layer and a cyan ink layer and optionally a black ink layer, each of which preferably has a given constant size, are repeatedly arranged in a side-by-side relation on single foundation in a recurring unit wherein the yellow, magenta and cyan ink layers and optionally the back ink layer are arranged in a predetermined order. The order of arrangement of these three or four color ink layers in the recurring unit can be arbitrarily determined in consideration of the superimposing order of the respective color ink layers or the like. The respective release layers which are interposed between the foundation and the color ink layers in correspondence to the yellow, magenta and cyan ink layers and optionally the black ink layer are formed to have respective heats of fusion satisfying the aforesaid condition in consideration of the transfer order of the respective color ink layers.

An example of the thermal transfer recording medium wherein the respective color ink layers are disposed on separate foundations comprises a combination of thermal transfer recording media comprising a first thermal transfer recording medium having a yellow ink layer on a first foundation, a second thermal transfer recording medium having a magenta ink layer on a second foundation and a third thermal transfer recording medium having a cyan ink layer on a third foundation, and optionally a fourth thermal transfer recording medium having a black ink layer on a fourth foundation. The respective release layers which are interposed between the respective foundations and color ink layers in correspondence to the yellow, magenta and cyan ink layers and optionally the black ink layer are formed to have respective heats of fusion satisfying the aforesaid condition in consideration of the transfer order of the respective color ink layers.

Each of the release layers comprises a wax as a main ingredient thereof and may be incorporated with a thermoplastic resin, as required.

Examples of specific waxes include natural waxes such as lanolin, carnauba wax, candelilla wax, montan wax and ceresine wax; petroleum waxes such as paraffin wax and microcrystalline wax; synthetic waxes such as oxidized wax, synthetic ester wax, low molecular weight polyethylene wax, α-olefin-maleic anhydride copolymer wax, urethane wax, Fischer-Tropsch wax and synthetic petroleum wax. These waxes can be used either alone or in combination.

Examples of specific thermoplastic resins include ethylene-vinyl acetate copolymer, ethylene-alkyl (meth) acrylate copolymer, vinyl chloride-vinyl acetate copolymer, polyesters, polyamides, epoxy resins, petroleum resins and rosin resins. These resins can be used either alone or in combination.

In order that the heat of fusion of the release layer for the first color and the heat of fusion of the release layer for the second color satisfy the aforesaid condition, kinds or proportions of waxes and, as required, thermoplastic resins used for the respective release layers are suitably selected.

With respect to other characteristics of the release layers, it is preferable that each release layer has a melting point of 60° to 90° C. and a melt viscosity of 1 to 1,000 cps/100° C. The coating amount (on a dry basis, hereinafter the same) of each release layer is preferably from about 0.05 to about 3 $g/m^2$.

Each of the color ink layers usable in the present invention is a heat-sensitive transferable color ink layer and comprises a coloring agent and a thermoplastic vehicle as main ingredients. The thermoplastic vehicle comprises a wax and/or a thermoplastic resin. The desired effect of the present invention can be outstandingly exhibited when the color ink layer is one having relatively high cohesive force wherein the vehicle thereof comprises a thermoplastic resin as a main ingredient. From this point of view, each color ink layer preferably has a melt viscosity of $10^3$ to $10^6$ cps/160° C.

Examples of specific waxes include natural waxes such as lanolin, carnauba wax, candelilla wax, montan wax and ceresine wax; petroleum waxes such as paraffin wax and microcrystalline wax; synthetic waxes such as oxidized wax, synthetic ester wax, low molecular weight polyethylene wax, a-olefin-maleic anhydride copolymer wax, urethane wax, Fischer-Tropsch wax and synthetic petroleum wax. These waxes can be used either alone or in combination.

Examples of specific thermoplastic resins (inclusive of elastomers) include ethylene-vinyl acetate copolymer, ethylene-vinyl butyrate copolymer, ethylene-(meth)acrylic acid copolymer, ethylene-alkyl (meth)acrylate copolymer, vinyl chloride polymer and copolymers such as polyvinyl chloride, vinyl chloride-vinyl acetate copolymer and vinyl chloride-vinyl alcohol copolymer, polyesters, polyamides, epoxy resins, cellulose resins, natural rubber, styrene-butadiene copolymer, isoprene polymer and chloroprene polymer, petroleum resins, rosin resins, terpene resins and cumarone-indene resins. These resins can be used either alone or in combination.

Coloring agents for yellow, magenta and cyan usable in the respective color ink layers are preferably transparent ones.

Examples of specific transparent coloring agents for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake, and dyes such as Auramine. These coloring agents may be used either alone or in combination.

Examples of specific transparent coloring agents for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake, and dyes such as Rhodamine. These coloring agents may be used either alone or in combination.

Examples of specific transparent coloring agents for cyan include organic pigments such as Victoria Blue Lake, metal-free Phthalocyanine Blue, Phthalocyanine Blue and Fast Sky Blue, and dyes such as Victoria Blue. These coloring agents may be used either alone or in combination.

The term "transparent pigment" herein refers to a pigment which gives a transparently colored ink when dispersed in a transparent vehicle.

Examples of coloring agents for black include pigments such as carbon black and Aniline Black, and dyes such as Nigrosine. These coloring agents may be used either alone or in combination.

The content of the coloring agent in each color ink layer is preferably from about 5 to about 60% by weight. Each color ink layer may be incorporated with a dispersing agent, an antistatic agent or the like, as required. The coating amount of each color ink layer is preferably from about 0.5 to about 2.0 $g/m^2$.

As the foundation for the thermal transfer recording medium of the present invention, there can be used polyethylene terephthalate film, polyethylene naphthalate film, polycarbonate film, polyamide film, aramid film, and condenser paper. A conventionally known sticking-preventive layer may be provided on the back side (the side adapted to come into slide contact with a thermal head) of the foundation. Examples of the materials for the sticking-preventive layer include various heat-resistant resins such as silicone resins, fluorine-containing resins and nitrocellulose resins, and other resins modified with these heat-resistant resins, such as silicone-modified urethane resins and silicone-modified acrylic resins, and mixtures of the foregoing heat-resistant resins and lubricating agent. The thickness of the foundation is usually from about 1 to about 10 $\mu$m. From the viewpoint of reducing heat spreading to increase the resolution of images, the thickness of the foundation is preferably from 1 to 4.5 $\mu$m.

The formation of a color image with use of the thermal transfer recording medium of the present invention is preferably performed as follows: With use of a thermal transfer printer, the yellow ink layer (including the color ink layer and the corresponding release layer, hereinafter the same), the magenta ink layer and the cyan ink layer are selectively melt-transferred onto a receptor in a predetermined order according to respective separation color signals of an original color image, i.e. yellow signals, magenta signals and cyan signals to form yellow ink dots, magenta ink dots and cyan ink dots on the receptor in a predetermined order, yielding a yellow separation image, a magenta separation image and a cyan separation image superimposed on the receptor. The order of transfer of the yellow ink layer, the magenta ink layer and the cyan ink layer can be determined as desired. When a usual color image is formed, all the three color ink layers are selectively transferred according to three color signals to form three color separation images on the receptor. When only two color signals are present, the corresponding two of the three color ink layers are selectively transferred to form two color separation images of a yellow separation image, a magenta separation image and a cyan separation image. Thus there is obtained a multi-color or full-color image involving a color region wherein a color is developed by virtue of subtractive color mixture of superimposed two or three color inks.

Of course, the thermal transfer recording medium of the present invention can also be applied to the formation of a color image wherein superimposing-transfer is performed by a heating means other than the thermal head, for example, irradiation with laser beam.

Preferred Embodiments

The present invention will be more fully described by way of Examples. It is to be understood that the present invention is not limited to the Examples, and various change and modifications may be made in the invention without departing from the spirit and scope thereof.

EXAMPLES 1 TO 3 AND COMPARATIVE EXAMPLES 1 TO 2

A 3.5 μm-thick polyethylene terephthalate film provided on one side thereof with a 0.2 μm-thick sticking-preventive layer composed of a silicone-modified acrylic resin was used as a foundation. Onto the opposite side of the foundation with respect to the sticking-preventive layer was applied and dried a coating liquid for release layer with the formula shown in Table 1, thereby forming a release layer having physical properties shown in Table 1. The heat of fusion was measured by means of a differential scanning calorimeter (DSC-210 made by Seiko Instruments Inc.).

Onto the thus formed release layer was applied and dried a coating liquid for color ink layer (magenta or cyan) with the formula shown in Table 2 according to the combination shown in Table 3, thereby forming a color ink layer having a softening point of 65° C., a melt viscosity of $1.4\times10^5$ cps/160° C. and a coating amount of 1.5 g/m$^2$. Thus a thermal transfer recording medium was obtained.

Using the thus obtained thermal transfer recording media, superimposing-printing was performed to determine the transfer ratio of the second color ink dot.

Evaluation Method

Figure 2:
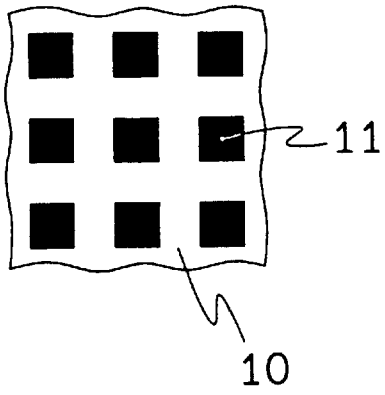
FIG. 2 is a partial plan view showing a printing pattern of second color ink dots which is used in a printing test using the thermal transfer recording medium of the present invention.

Using the thermal transfer recording medium for cyan color (the first color), solid-printing was performed on a sheet of plain paper under the printing conditions mentioned below. Then, one-dot printing was performed in the pattern shown in FIG. 2 under the same printing conditions as above by using the thermal transfer recording medium for magenta color (the second color). In FIG. 2, reference numeral 10 denotes the solid-printed part for the first color, and reference numeral 11 denotes the second color ink dots.

Thermal transfer printer: PCPR 150 V made by NEC Corp.

Printing energy: 18 mJ/mm$^2$

Printing speed: 100 characters per second

Size of heating element: 80 μm×80 μm

The results are shown in Table 3.

$$\text{Transfer ratio (\%)} = \frac{\text{Number of ink dots perfectly transferred}/\text{cm}^2}{\text{Total number of ink dots}/\text{cm}^2}\times 100$$

A: Transfer ratio≧90%

B: 80%≦Transfer ratio<90%

C: Transfer ratio<80%

TABLE 1

| Release layer No. | ① | ② | ③ | ④ |
|---|---|---|---|---|
| Formula (% by weight) | | | | |
| Carnauba wax | 5 | 5 | 5 | |
| Petrolatum | 5 | | | |
| Microcrystalline wax | | 5 | | |
| Paraffin wax | | | 5 | 10 |
| Toluene | 90 | 90 | 90 | 90 |
| Physical property | | | | |
| Coating amount (g/m$^2$) | 1.0 | 1.0 | 1.0 | 1.0 |
| Heat of fusion (mJ/mg) | 80 | 140 | 170 | 220 |
| Melting point (° C.) | 79 | 81 | 76 | 74 |
| Melt viscosity (cps/100° C.) | 45 | 48 | 28 | 11 |

TABLE 2

| | Color ink | |
|---|---|---|
| Formula (part by weight) | Magenta | Cyan |
| Ethylene-vinyl acetate copolymer*[1] | 60 | 60 |
| Petroleum resin | 10 | 10 |
| Carnauba wax | 10 | 10 |
| Brilliant Carmine 6B | 20 | |
| Phthalocyanine Blue | | 20 |
| Toluene | 400 | 400 |

*[1]Content of vinyl acetate: 28% by weight, melt flow index: 150/190° C.

TABLE 3

| | First color | | | Second color | | | |
|---|---|---|---|---|---|---|---|
| | Release layer | | | Release layer | | | Transfer ratio |
| | No. | Heat of fusion (mJ/mg) | Color ink layer | No. | Heat of fusion (mJ/mg) | Color ink layer | of second color ink dot |
| Ex. 1 | ① | 80 | Cyan | ② | 140 | Magenta | A |
| Ex. 2 | ② | 140 | Cyan | ④ | 220 | Magenta | A |
| Ex. 3 | ③ | 170 | Cyan | ④ | 220 | Magenta | B |
| Com. Ex. 1 | ③ | 170 | Cyan | ③ | 170 | Magenta | C |
| Com. Ex. 2 | ③ | 170 | Cyan | ② | 140 | Magenta | C |

With respect to the obtained printed matter, the transfer ratio of the second color ink dot defined by the following formula was determined and the superimposing performance was evaluated according to the following criterion.

In addition to the materials and ingredients used in the Examples, other materials and ingredients can be used in the present invention as set forth in the specification to obtain substantially the same results.

The thermal transfer recording medium of the present invention has the structure wherein a release layer comprising a wax as a main ingredient thereof is interposed between a foundation and a color ink layer. However, since the heat of fusion of the release layer for a first color and the heat of fusion of the release layer for a second color satisfy the above-mentioned specific relationship, the second color ink dots can be satisfactorily transferred on the first color ink dots, resulting in a color image with good color reproducibility.

What is claimed is:

1. A method for forming a color image by superimposing transfer of a plurality of different color inks, comprising the steps of:

providing a thermal transfer recording medium comprising a foundation, wherein a first color ink layer and a second color ink layer provided on the foundation in a side-by-side relation, and a first release layer and a second release layer comprising a wax interposed between the foundation and the first color ink layer and the second color ink layer respectively, wherein the heat of fusion C1of the first release layer and the heat of fusion C2 of the second release layer satisfy the relationship represented by formula (I):

$$C1<C2 \quad \text{(I)},$$

selectively melting-transferring the first color ink layer with the first release layer and the second color ink layer with the second release layer onto a receptor, provided that the first color ink layer is transferred previous to the second color ink layer.

2. The method for forming a color image of claim 1, wherein the heat of fusion C1 of the first release layer satisfies the relationship represented by formula (II):

$$160\ mJ/mg \geqq C1 \quad \text{(II)}.$$

3. The method for forming a color image of claim 1, wherein the heat of fusion C1 of the first release layer and the heat of fusion C2 of the second release layer satisfy the relationship represented by formula (III):

$$30\ mJ/mg \leqq C2-C1 \quad \text{(III)}.$$

4. A method for forming a color image by superimposing transfer of a plurality of different color inks, comprising the steps of:

providing a combination of a plurality of thermal transfer recording media comprising a first thermal transfer recording medium comprising a first foundation, a first color ink layer provided on the first foundation, and a first release layer comprising a wax interposed between the first foundation and the first color ink layer, and a second thermal transfer recording medium comprising a second foundation, a second color ink layer provided on the second foundation, and a second release layer comprising a wax interposed between the second foundation and the second ink layer, wherein the heat of fusion C1 of the first release layer and the heat of fusion C2 of the second release layer satisfy the relationship represented by formula (I):

$$C2<C2 \quad \text{(I)},$$

selectively melting-transferring the first color ink layer with the first release layer and the second color ink layer with the second release layer onto a receptor, provided that the first color ink layer is transferred previous to the second color ink layer.

5. The method for forming a color image of claim 4, wherein the heat of fusion C1 of the first release layer satisfies the relationship represented by formula (II):

$$160\ mJ/mg \geqq C1 \quad \text{(II)}.$$

6. The method for forming a color image of claim 4, wherein the heat of fusion C1 of the first release layer and the heat of fusion C2 of the second release layer satisfy the relationship represented by formula (III):

$$30\ mJ/mg \leqq C2-C1 \quad \text{(III)}.$$

* * * * *